US008701539B1

(12) United States Patent
Dreizin et al.

(10) Patent No.: US 8,701,539 B1
(45) Date of Patent: Apr. 22, 2014

(54) EXPANDABLE ELECTROMAGNETIC LAUNCHER

(71) Applicant: General Electrodynamics International, LLC, Golden Valley, MN (US)

(72) Inventors: Yuri Arnoldovich Dreizin, Golden Valley, MN (US); Lawrence J. Lukis, Wayzata, MN (US); Dmitri Rebrov, Minneapolis, MN (US)

(73) Assignee: General Electrodynamics International, LLC, Golden Valley, MN (US)

( * ) Notice: Subject to any disclaimer, the term of this patent is extended or adjusted under 35 U.S.C. 154(b) by 0 days.

(21) Appl. No.: 13/836,623

(22) Filed: Mar. 15, 2013

(51) Int. Cl.
*F41F 1/00* (2006.01)

(52) U.S. Cl.
USPC ..... 89/8; 124/3

(58) Field of Classification Search
USPC ..... 89/8; 124/3; 310/12.07
See application file for complete search history.

(56) References Cited

U.S. PATENT DOCUMENTS

| | | | | |
|---|---|---|---|---|
| 1,370,200 | A * | 3/1921 | Fauchon-Villeplee | 124/3 |
| 2,235,201 | A * | 3/1941 | Cole | 124/3 |
| 4,319,168 | A | 3/1982 | Kemeny | |
| 4,343,223 | A | 8/1982 | Hawke et al. | |
| 4,433,608 | A | 2/1984 | Deis et al. | |
| 4,677,895 | A | 7/1987 | Carlson et al. | |
| 4,766,366 | A | 8/1988 | Davis | |
| 4,796,511 | A | 1/1989 | Eyssa | |
| 4,901,620 | A | 2/1990 | Kemeny | |
| 5,076,135 | A * | 12/1991 | Hurn et al. | 89/8 |
| 5,127,308 | A | 7/1992 | Thompson | |
| 5,285,763 | A | 2/1994 | Igenbergs | |
| 5,375,504 | A | 12/1994 | Bauer | |
| 5,431,083 | A | 7/1995 | Vassioukevitch | |
| 6,502,494 | B2 | 1/2003 | Marshall | |
| 6,725,759 | B1 | 4/2004 | Kathe et al. | |
| 7,634,989 | B2 | 12/2009 | Ignatiev | |
| 7,730,821 | B2 | 6/2010 | Taylor | |
| 8,371,205 | B1 * | 2/2013 | Proulx | 89/8 |
| 2012/0260901 | A1 | 10/2012 | Proulx | |

OTHER PUBLICATIONS

"Railgun—Wikipedia®, the free encyclopedia", [online]. [retrieved on Apr. 2, 2013]. Retrieved from the Internet: <URL:http://en.wikipedia.org/wiki/Railgun>, (2013), 9 pgs.

Bauer, D.P., et al., "High Performance Railgun Barrels for Laboratory Use", *IEEE Trans on Magnetics,* vol. 29, No. 1 (Jan. 1993), 362-367.

Beno, J. H., et al., "An investigation into the potential for multiple rail railguns", *IEEE Trans. on Magnetics,* 25(1), (Jan. 1989), 92-96.

Dreizin, Y., "Inductiveless Rail Launchers for Long Projectiles", Defense Technical Information Center Compilation Part Notice—ADP012471, *Proceedings of the 10th U.S. Army Gun Dynamics Symposium,* (2002), 279-290.

(Continued)

*Primary Examiner* — Gabriel Klein
(74) *Attorney, Agent, or Firm* — Schwegman, Lundberg & Woessner, P.A.

(57) ABSTRACT

An electromagnetic launcher operable to accelerate launch packages of various transverse sizes, the launcher comprising, in one example, two high-current linear motors having longitudinally extending, laterally open propulsion channels configured to receive and accelerate metal armatures integrated with a launch package; and a power actuated repositioning mechanism for spacing the motors apart as needed.

19 Claims, 16 Drawing Sheets

(56) References Cited

OTHER PUBLICATIONS

Haight, C. H., et al., "Distributed Energy Store (DES) Railgun Development", *IEEE Trans. on Magnetics,* vol. MAG-22, No. 6, (Nov. 1986), 1499-1502.

Holland, L., "Distributed-Current-Feed and Distributed-Energy-Store Railguns", *IEEE Trans.on Magnetics,* vol. MAG-20, No. 2, (Mar. 1984), 272-275.

Long, G. C. et al., "Limits to the Velocity of Solid Armatures in Railguns", *IEEE Trans. on Magnetics,* 25(1), Fourth Symposium on Electromagnetic Launch Technology, Austin, TX, (1989), 347-352.

Maniglia, J., et al., "Design, Fabrication, and Testing of an Electromagnetic Rail Gun for the repeated testing and simulation of Orbital Debris Impacts", American Institute of Aeronautics and Astronautics, (Jun. 2011), 23 pgs.

Muller, R. A. et al., "Impact Fusion with a Segmented Rail Gun", Jason Technical Note JSN-79-05, (Dec. 1979), 16 pgs.

* cited by examiner

EXPANDABLE ELECTROMAGNETIC LAUNCHER

TECHNICAL FIELD

The invention pertains to electromagnetic launchers and high-current linear motors, and more specifically to an expandable electromagnetic launcher.

BACKGROUND

Conventional powder guns can fire subcaliber projectiles inserted in protective and obturating casings, or sabots, which can be discarded on exit. Sabots allow firing projectiles with different cross sections from the same gun, considered a valuable capability. The diameters of the projectiles cannot exceed the fixed gun barrel caliber, a self-evident limitation of this technique. Electromagnetic launchers also accelerate launch packages in which subcaliber projectiles are inserted in sabots, with the same limitation.

Electromagnetic launchers are being developed to accelerate various projectiles to high velocities not achievable by conventional guns. Other potential applications include accelerating self-propelled missiles, decoys, torpedoes and other massive objects, to lower velocities but on relatively short launch paths. When matured, electromagnetic launchers may find uses in commercial applications (e.g., rock pulverizing in mines was considered in the U.S. Pat. No. 7,634,989).

Pulse power sources energizing electromagnetic launchers, such as capacitor banks or rotational electrical generators, can release very large amounts of energy, currently approaching 100 MJ, in short pulses of high current on the order of millions of Amperes, typically in 3-10 millisecond duration range for high velocity launchers. Together with their pulse forming networks, pulse power sources are the heaviest, bulkiest and most expensive part of electromagnetic launch systems. It would be advantageous for such systems to fire launch packages of various transverse sizes using a single pulse power source with sabots sized appropriately for different projectiles, small and large, reducing waste associated with accelerating oversized sabot used to fit a smaller projectile with a large caliber barrel.

While it is possible to use with a single pulse power source several electromagnetic launchers with different fixed calibers, a versatile launcher capable of adopting a variety of launch packages would in many cases be preferable. One attempt to address this need, the U.S. Pat. No. 4,901,620 issued to G. A. Kemeny provided a railgun having several bores of different calibers in a single barrel as shown in FIG. 1. Kemeny's solution, however, has its own shortcomings related to the oversized barrel.

DETAILED DESCRIPTION

Introduction

Figure 1:
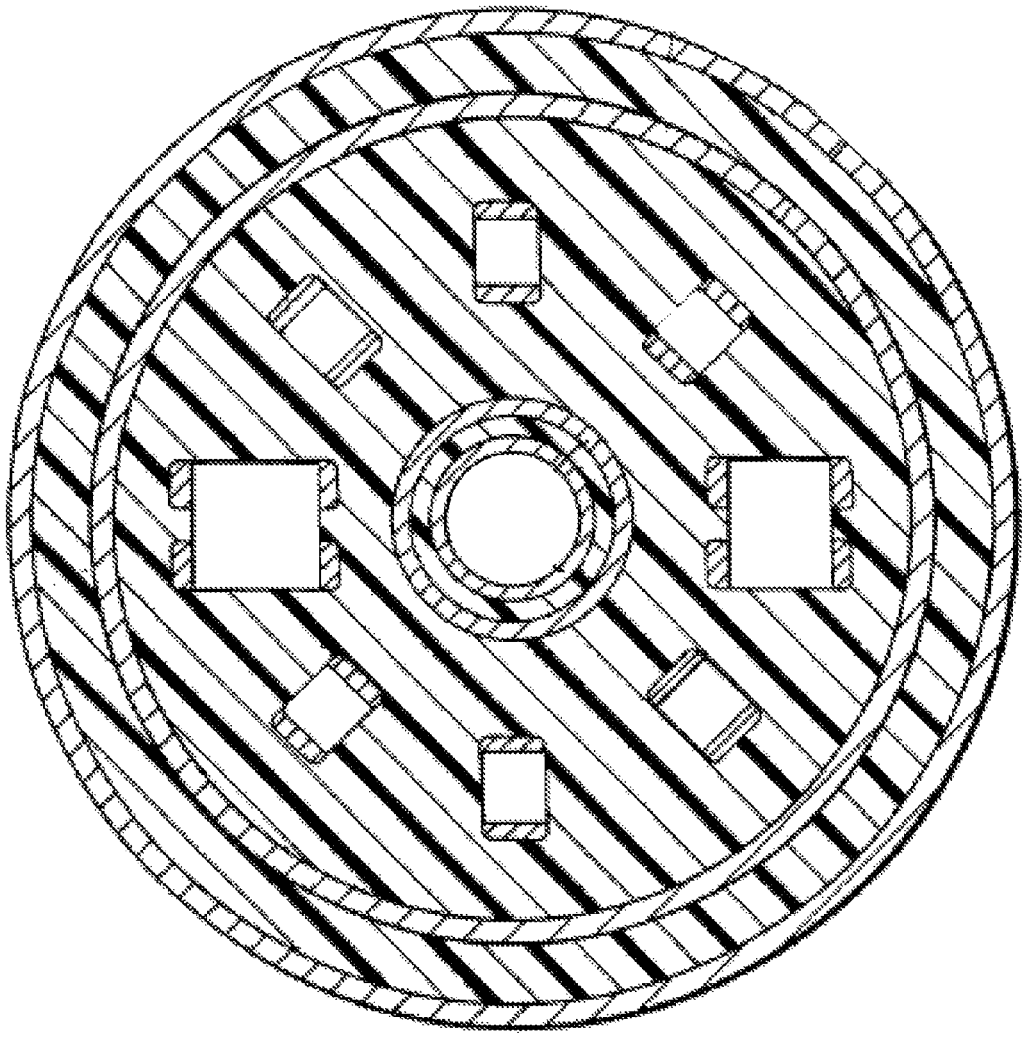
FIG. 1 (PRIOR ART)
FIG. 1 illustrates a multi-bore railgun according to prior art.

Electromagnetic launchers are, in essence, high-current linear electrical motors complemented by auxiliary mechanisms and devices as needed in specific applications. The present subject matter provides a versatile electromagnetic launcher capable of accelerating launch packages with various transverse sizes. Examples achieve this by using, instead of a single high-current linear motor, a plurality of high-current linear motors having longitudinally extending, laterally open propulsion channels. Such motors are termed herein "laterally open motors", and sometimes "open motors" for brevity. To adopt launch packages of different transverse sizes, the motors can be coupled to a power actuated repositioning mechanism operable to space them apart into desired configurations, thus making the launcher expandable.

To provide context, certain operational aspects are discussed. Metal armatures in electromagnetic launchers are propelled by Lorentz force with volume density $j \times B$, j being the electric current density and B magnetic flux density. The total force exerted on a conductor, such as an armature or a rail in electromagnetic launcher, can be found by integrating $j \times B$ over the volume of the conductor. The nature of electromagnetic force is thus different from the gas pressure force applied to the surface of a body.

The electromagnetic force exerted on a conductor can also be expressed as an integral of the magnetic pressure tensor over the surface of the conductor. The level of magnetic pressure in electromagnetic launchers can be on par with gas pressure in powder guns, and in many cases similarly large bursting forces must be contained. Contrary to gas pressure, however, magnetic pressure is anisotropic; one can think of magnetic flux as being compressed across and stretched along the magnetic flux lines. This difference, exploited by examples disclosed herein, manifests itself, in particular, in attraction or repulsion of parallel current-carrying conductors depending on whether the directions of electrical currents in them are coincidental or opposite.

In the context of the present disclosure, the term "high-current" refers to electrical motors in which maximum magnetic pressure exceeds at least one hundred psi, and can reach tens of thousands psi. Magnetic pressure of such magnitude cannot be created without conductors carrying extremely high electric current, as magnetic materials do not produce that high magnetic pressure. Thus high-current motors are rather different from so called reluctance motors, in which magnetic field is predominantly created by materials with high magnetic permeability.

There are several types of electromagnetic launchers. The present subject matter is concerned with a family of such launchers in which propelling force is applied to a metal armature receiving electric current from contact rails. One way to outline this family is to start with the most basic electromagnetic rail launcher called simple or classic railgun, and then to list distinctive aspects of other members of this family, as well as different techniques used for containment of high magnetic pressure.

The simple railgun is the most developed type of electromagnetic launcher, probably by virtue of being more robust and easier to build. Other launchers in the railgun family have more complex electrical and mechanical design aspects intended for improved efficiency or other gains, but often tending to compromise structural robustness which is of paramount importance for electromagnetic launchers subjected to extremely high pulsed forces during the launch and intensive vibrations in its wake.

The conceptual design of the simple railgun (or, its architecture) is described in a number of sources including Wikipedia. It comprises two parallel continuous metal rails coextending from breech to muzzle and defining, in the language used in the present subject matter, the propulsion channel between the rails. At the breech the rails are connected to a pulse power source. A metal armature traveling in the propulsion channel makes sliding electrical contact with both rails so that the current from the power source loops through the armature. Spacing between the contact rails is maintained by electrical insulators serving also as the side walls of the propulsion channel. The rails together with the side wall insulators and backing insulators form the core of the simple railgun. In railguns with metal armatures, very stiff materials such as ceramics are preferably used for side wall insulators, while containment structure around the core preferably provides strong compressive preloading. Preloading of stiff side wall insulators helps to prevent or minimize gaps tending to appear between the rails and the traveling armature as a result of strong repulsion between the contact rails carrying very high current in opposite directions.

Even a brief systematic description of other members of the railgun family would take up too much space herein. Instead, their major features as well as barrel construction techniques optionally employed in them are listed below and linked to the cited references wherein they are discussed in detail:

1) multiple contact rails carrying current along the launch path (Carlson; Beno; Igenbergs; Marshall), or continuous contact rails connected to a parallel low inductance electrical transmission line (Eyssa);
2) current-carrying conductors not contacting the armature but augmenting the magnetic field created by contact rails (Hawke; Deis 1984; Deis 1988; Bauer 1994; Taylor), or even serving as the main source of magnetic field, especially if the use of superconductors is envisioned (Eyssa);
3) reducing magnetic energy contained in the launcher at any given time by segmentation of contact rails. i.e., by dividing the rails into shorter segments receiving electrical current via individual feeders either from
   a) multiple separate power sources distributed along the launch path (Muller; Hawke; Kemeny 1982; Holland; Haight; Thompson); or from
   b) common electrical transmission line extending along the launch path and distributing electric current from a single power source to multiple rail segments (Bauer 1994; Vassioukevitch; Dreizin);
4) partial overlap, also called nesting, of neighboring rail segments to increase their inductive coupling and reduce the energy loss when a traveling armature loses contact with a rail segment (Thompson; Bauer 1994; Dreizin);
5) construction techniques for containment of magnetic pressure and preloading the launcher core:
   a) wound up barrels using tensioned tapes made out of strong composite materials (Jackson);
   b) laminated steel containment structure (Bauer 1993);
   c) containment and preloading by Belleville disks (Kathe).

For architectures combining two or more enumerated features, the corresponding publications are mentioned more than once in the above list.

It is believed that the closest prior art references to the present subject matter are provided by U.S. Pat. No. 6,502,494 to Marshall; and Y. Dreizin, "Inductiveless Rail Launchers for Long Projectiles", Proc. of the 10th U.S. Army Gun Symposium, 2002, pp. 279-290, the latter of which is hereby incorporated herein by reference in its entirety.

Electromagnetic launchers of prior art are not readily reconfigurable for adopting launch packages with various transverse sizes. However, the launcher architectures discussed in the referenced above publications can be reused in designing laterally open motors for expandable launchers.

The disclosure of the present subject matter starts below with the description of exemplary embodiments comprising two laterally open simple railguns. These embodiments cover a number of common aspects of expandable launchers, including, in particular, containment and preloading means, as well as two forms of the repositioning mechanism. Next is presented an exemplary embodiment of a novel laterally open high-current motor, termed herein "an open ultra-segmented motor", which also can be used in expandable launchers.

Attempts to readily expand barrels of conventional powder guns, for example by splitting them and then inserting spacers along the splits, in order to adopt sabots of different transverse sizes, may not be practicable, since very high bursting forces may be difficult or impossible to contain by readily releasable means, e.g. quick-release fasteners. The expandable electromagnetic launchers of the present subject matter do not have this problem because open motors, when placed in a mirror configuration, do not repel but rather attract each other, and attraction is significantly easier to contain than repulsion. Within each laterally open motor, repulsion of conductors with oppositely directed currents still has to be contained. As the annular containment structures of conventional barrels cannot be used with laterally open motors, they can be substituted by sufficiently strong one-sided (cantilevered) containment structures, such as C-clamps. Fortunately, containment and preloading means for laterally open motors in expandable launchers do not have to be readily releasable.

Containment and Preloading in Expandable Launchers with Open Motors.

To simplify the following descriptions, only the launcher configurations with two essentially identical laterally open motors disposed in mirror position with respect to each other will be expressly disclosed in embodiments presented herein. Such configurations can be more practical, while generalizations covering configurations with three or more motors are contemplated. In the vertically expandable form, considered first, two open motors are positioned one above the other, being separated by a horizontal plane about which the motors are mirror symmetrical, including coincidental directions of electric current in the mirror symmetrical conductors. Such a configuration can provide at least two propulsion channels.

Figure 2:
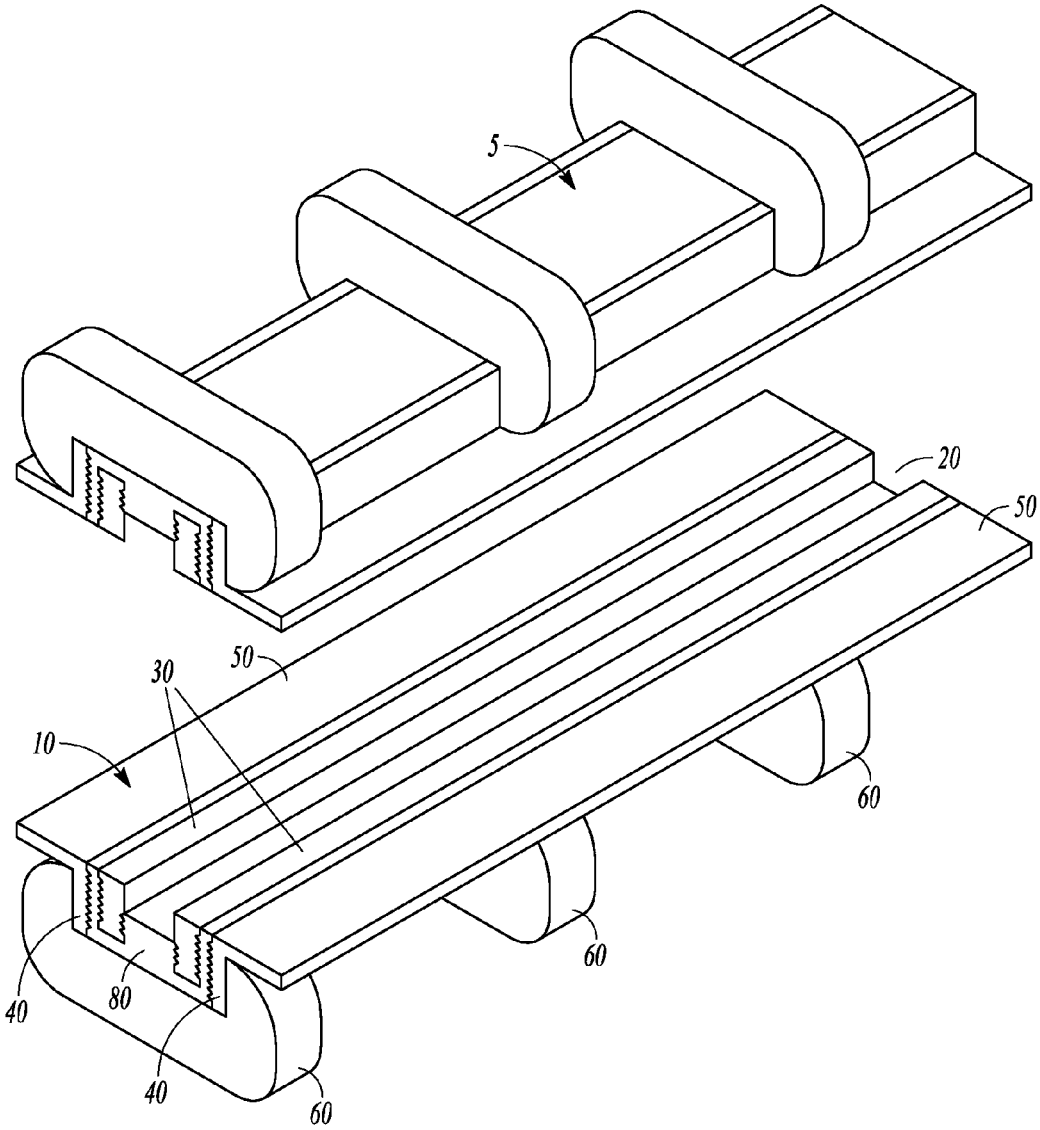
FIG. 2 illustrates a section of expandable launcher, with open railgun motors, according to an example.

FIG. 2 presents a perspective view of short sections of two laterally open motors 5 and 10 of simple railgun type, in an embodiment. Because they are identical, it is sufficient to describe one of them. The motor 10 defines an open propulsion channel 20 with electrically and mechanically continuous contact rails 30 disposed on its opposite sides. The core of the motor can be sandwiched between two angle beams 40. The horizontal legs of the angle beams can serve as longitudinal flanges 50 of the open motor. To counteract repulsion forces between contact rails 30, C-clamps 60 can be distributed along the length of the motor, with spacing between them selected to provide necessary level of containment. The clamps can embrace the core over vertical legs of the angle beams and, when properly designed and used, preload the core. Grooved interfaces between the rails 30, the core insulators 80 and the angle beams 40 can help consolidate the clamped structure and can prevent dislodging of the rails from their slots by the attraction force exerted between each rail and its mirror image rail in the other motor.

Figure 3:
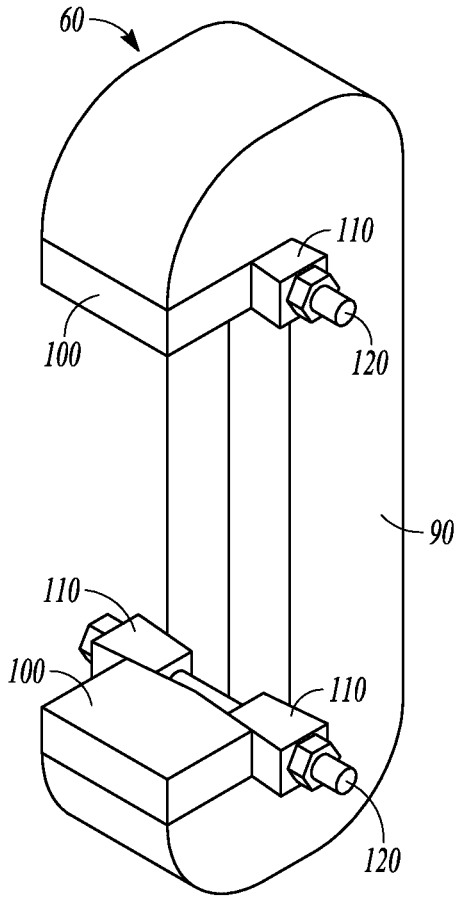
FIG. 3 illustrates a C-clamp with high mechanical advantage, according to an example.

While different types of C-clamps can be used by those skilled in the art, FIG. 3 depicts an exemplary embodiment for one such C-clamp 60. The clamp includes the clamp bracket 90, wedge members of two types, 100 and 110, and the screws 120 connecting the wedge members 110. The clamp can provide high mechanical advantage if the lubricated friction pairs of three simple machines in it have sufficiently low coefficients of friction, desirably in the range of 0.3-0.15 or better. The clamping can be achieved by fastening the screws 120, through one or both of mechanical and powered means.

Mechanism for Adjustable Spacing of Open Motors in Vertically Expandable Launchers.

Figure 4:
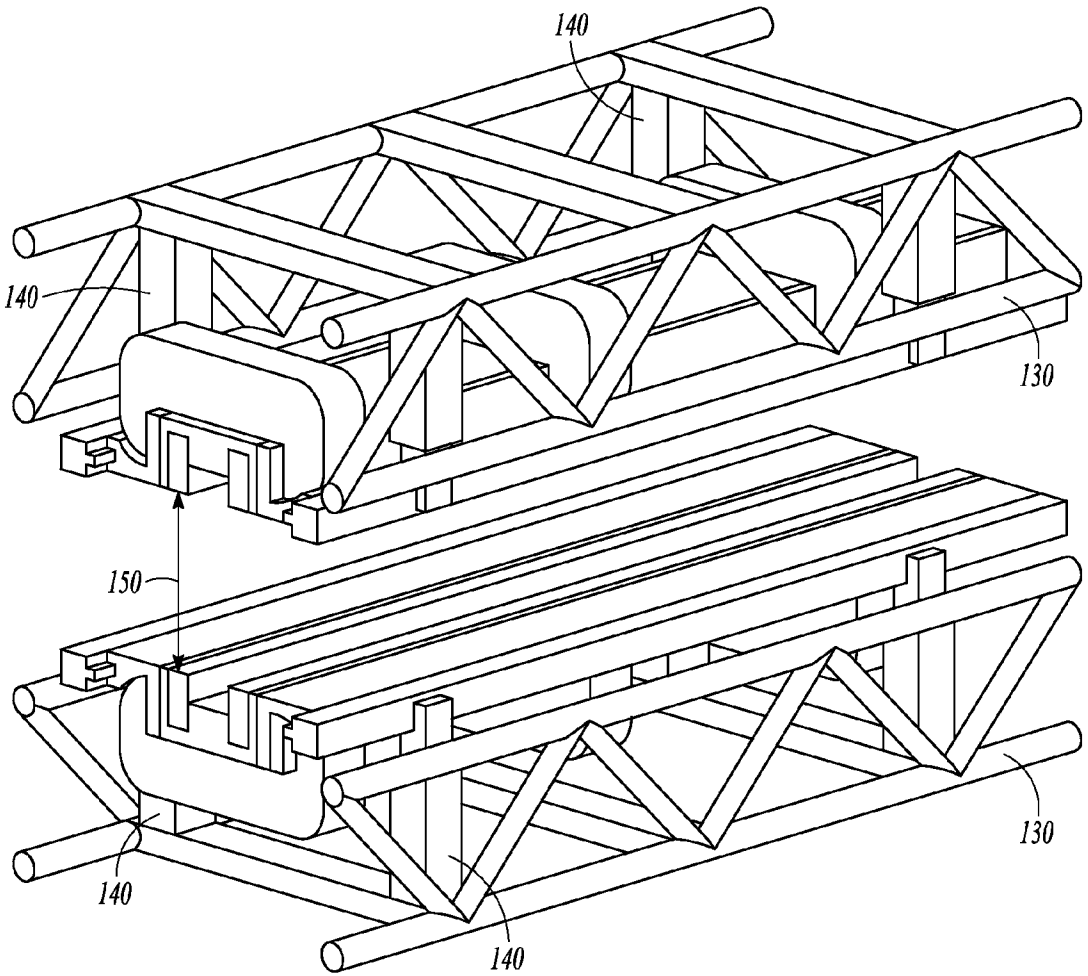
FIG. 4 illustrates support trusses and repositioning mechanism for vertically expandable launcher, according to an example.

As shown in FIG. 4, the open high-current motors in the first exemplary embodiment are supported or braced by support structure such as two coextending trusses 130. The trusses can be rigidly connected with each other, for example near their ends (not shown in this figure). The power actuated repositioning mechanism can comprise one or more servo actuators 140 coupling the open high-current motors with the trusses, at several points distributed along the motors. Each motor can be coupled with only one truss as shown. Many different types of actuators can be employed, such as hydraulic cylinders, linear electrical actuators, lead screws and others. The spacing 150 between the open motors can be adjusted by the actuators in response to a signal communicated with a controller, such as an electronic and/or hydraulic controller. The selection of particular power actuated repositioning means (or manually actuated, in some cases) may depend on the application, and thus may be different in laboratory launchers and fieldable ones. Coupling between actuator rods and flanges of a high-current open motor is described below.

Figure 5:
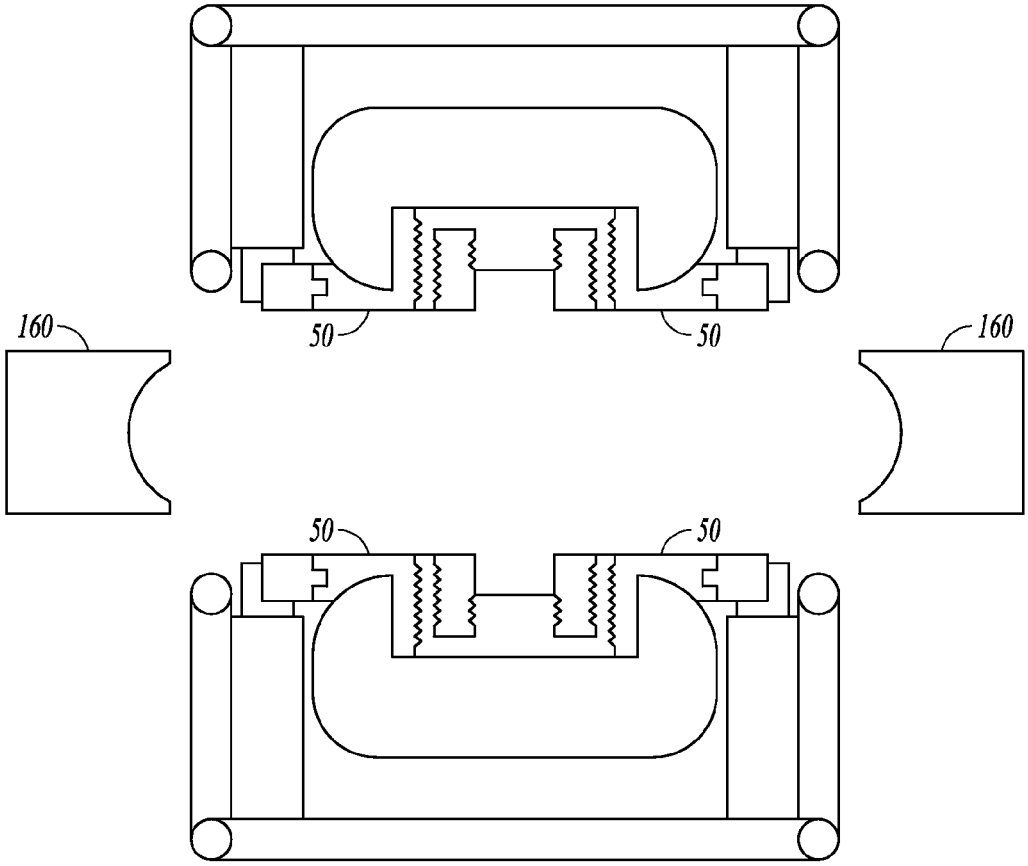
FIG. 5 shows a cross-sectional view of spacer bars being inserted between open motors, according to an example.
Figure 6:
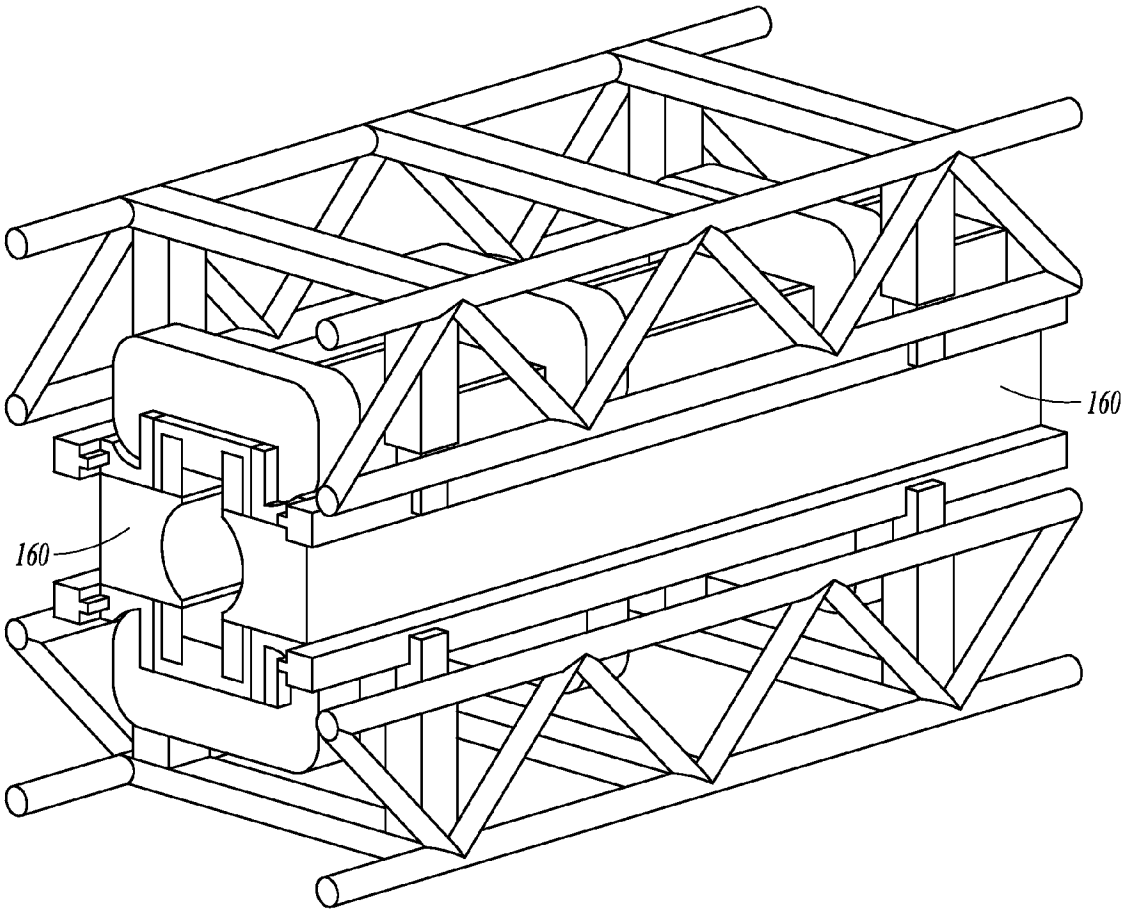
FIG. 6 illustrates a section of the vertically expandable launcher with inserted spacer bars, according to an example.

During the launch, mutual attraction of open motors may be quite strong, especially when they are in close proximity to each other. To counteract the attraction forces, coextending spacer bars 160, which can be profiled to form a launch channel for a launch package, can be inserted between the flanges 50 of two motors. These spacer bars are shown, in FIG. 5, in exploded view, and fully inserted, in FIG. 6. In an embodiment, V-grooves and matching protrusions can be formed in the flanges 50 to mate with complementary protrusions and V-grooves formed on the sides of the spacer bars 160, aligning the open motors.

Figure 7:
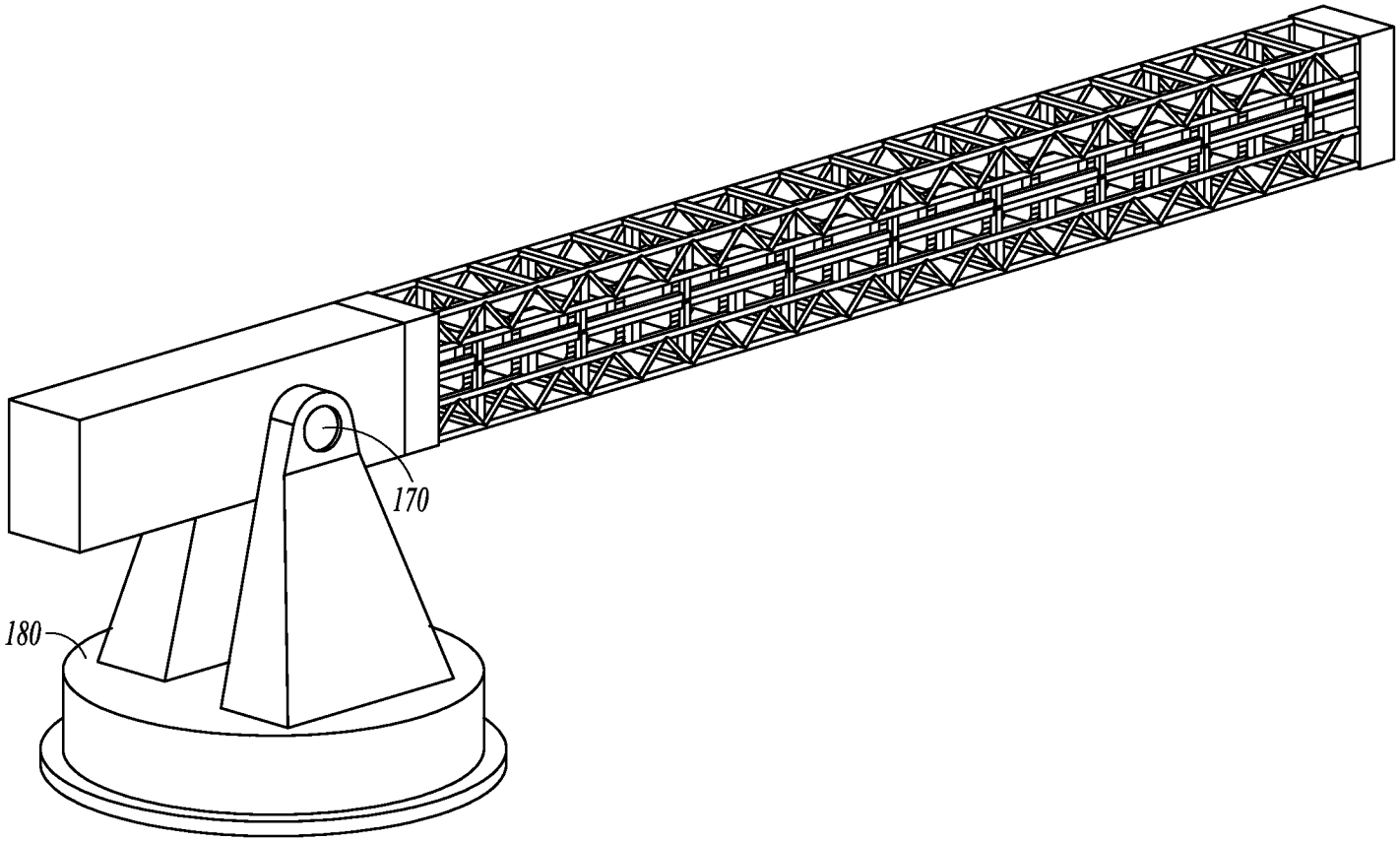
FIG. 7 illustrates a cantilevered vertically expandable launcher, according to an example.

FIG. 7 illustrates the described embodiment of a cantilevered vertically expandable electromagnetic launcher. The launcher is elevatably supported by a trunnion 170 supported by a rotatable mount 180, and driven by hydraulic cylinders or other conventional actuators.

Barrel Droop Compensation and Recoil Mitigation in Expandable Electromagnetic Launchers.

Two other aspects to be considered for expandable launchers are barrel droop and recoil mitigation. For several reasons, barrel droop can be a more troubling issue with high velocity electromagnetic launchers than with conventional powder guns. First, designs of high-current rail launchers using metal armatures place strong emphasis on providing sufficient preloading to the core, often at the expense of longitudinal flexural stiffness. Second, an armature traveling at higher velocity in a curved propulsion channel exerts stronger centrifugal force on its walls contributing to their greater wear and damage. Third, despite increased droop, longer barrels could be used to lower the level of pulse power handled by the pulse forming network.

Figure 8:
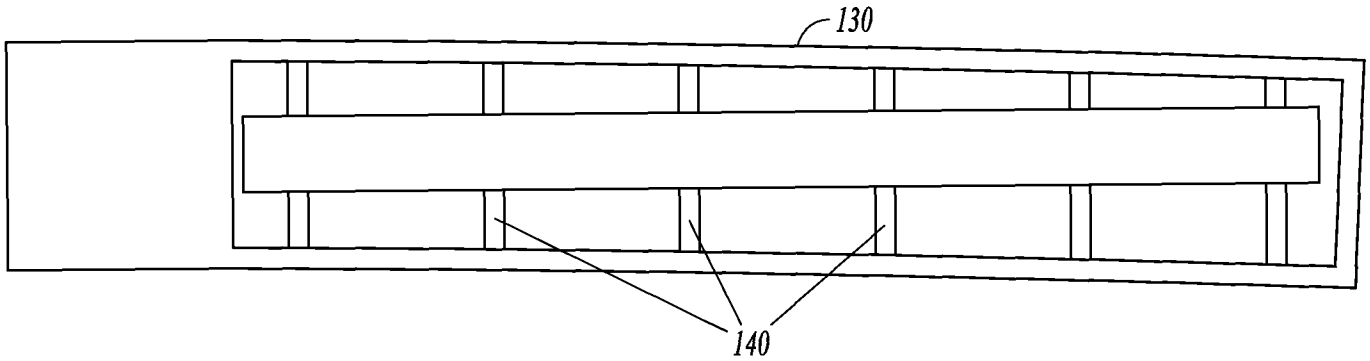
FIG. 8 is a schematic of barrel droop compensation, according to an example.

One way to reduce barrel droop is to use larger, stronger and heavier angle beams 40 and trusses 130. In a better performing alternative, the droop can be compensated using the servo actuators 140 already present in the vertically expandable launcher. By fine control of the servo actuators, the open motors can be straightened up while trusses 130 are allowed to droop considerably under the weight of the structure. This is shown schematically in FIG. 8.

If barrel droop compensation is employed, the servo actuators 140 can be controlled using input from sensors (not shown) monitoring straightness of the propulsion channels. A closed loop control can be especially useful if barrel droop substantially depends not only on launcher elevation, but on certain other factors, such as fast launcher aiming imparting inertial stress on the launcher, and/or motion of a vehicle to which a launcher is attached.

Figure 9:
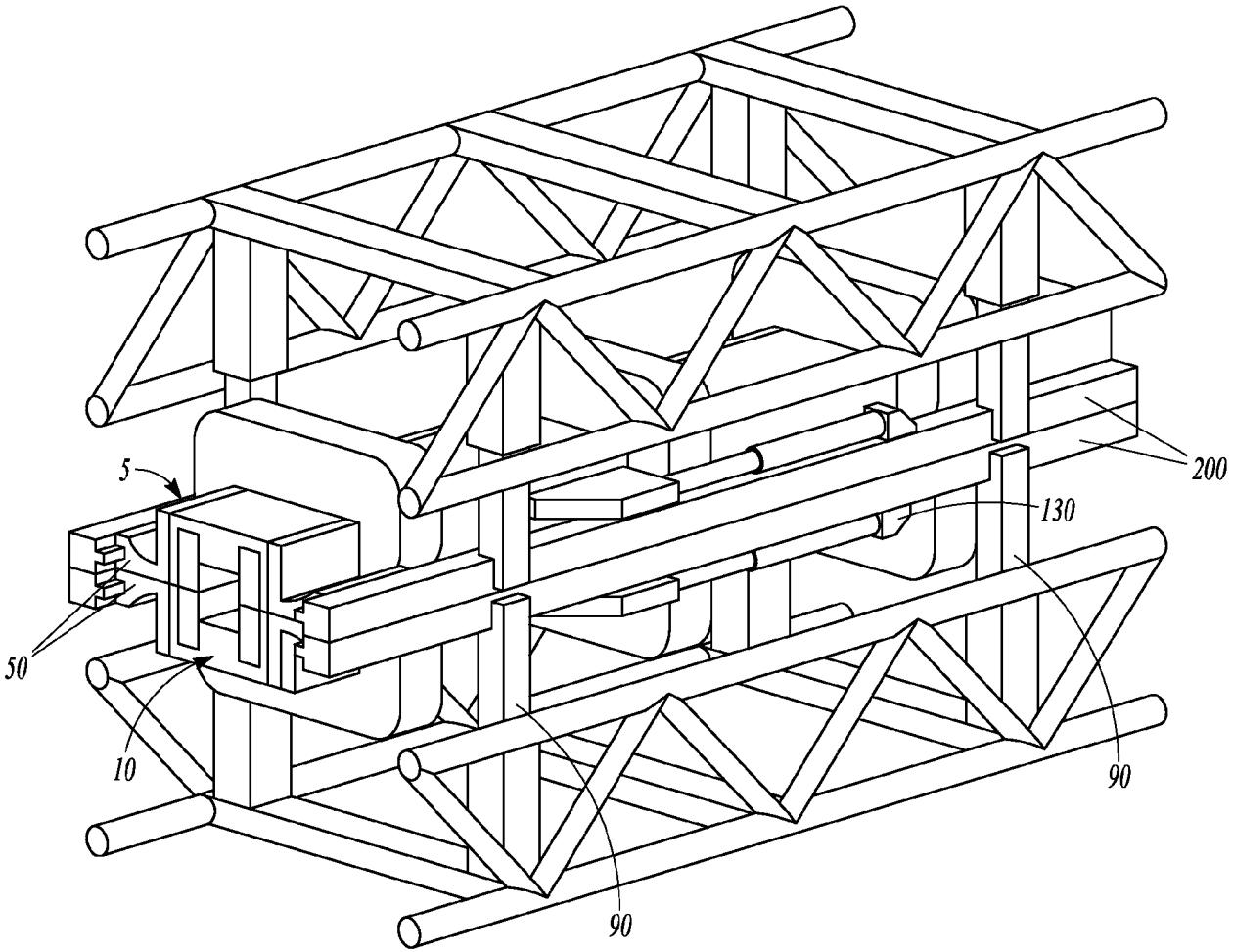
FIG. 9 shows recoil mitigation means, according to an example.

FIG. 9 presents structural elements relating to recoil mitigation in the expandable launcher. The launcher is shown in a configuration with little or no spacing between the open motors 5 and 10, when their propulsion channels form a conventional bore. In one example, the ends of actuator rods 190 can be pivotally attached to bars 200. The latter can be slidably engaged with edges of flanges 50, such that after the firing the motors 5 and 10 can slide with respect to the slide bars 200 and trusses 130 before recoil buffers 210 stop them and return to the initial position.

Horizontally Expandable Launcher

Figure 10:
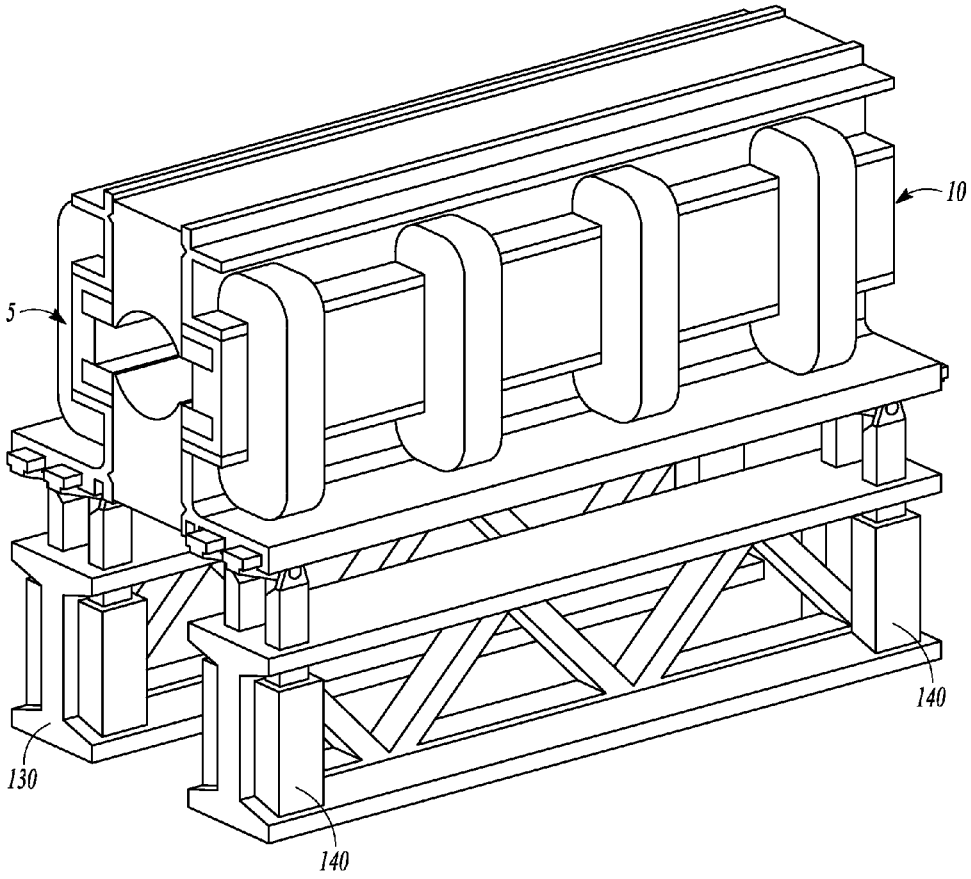
FIG. 10 shows a section of horizontally expandable launcher, according to an example.
Figure 11:
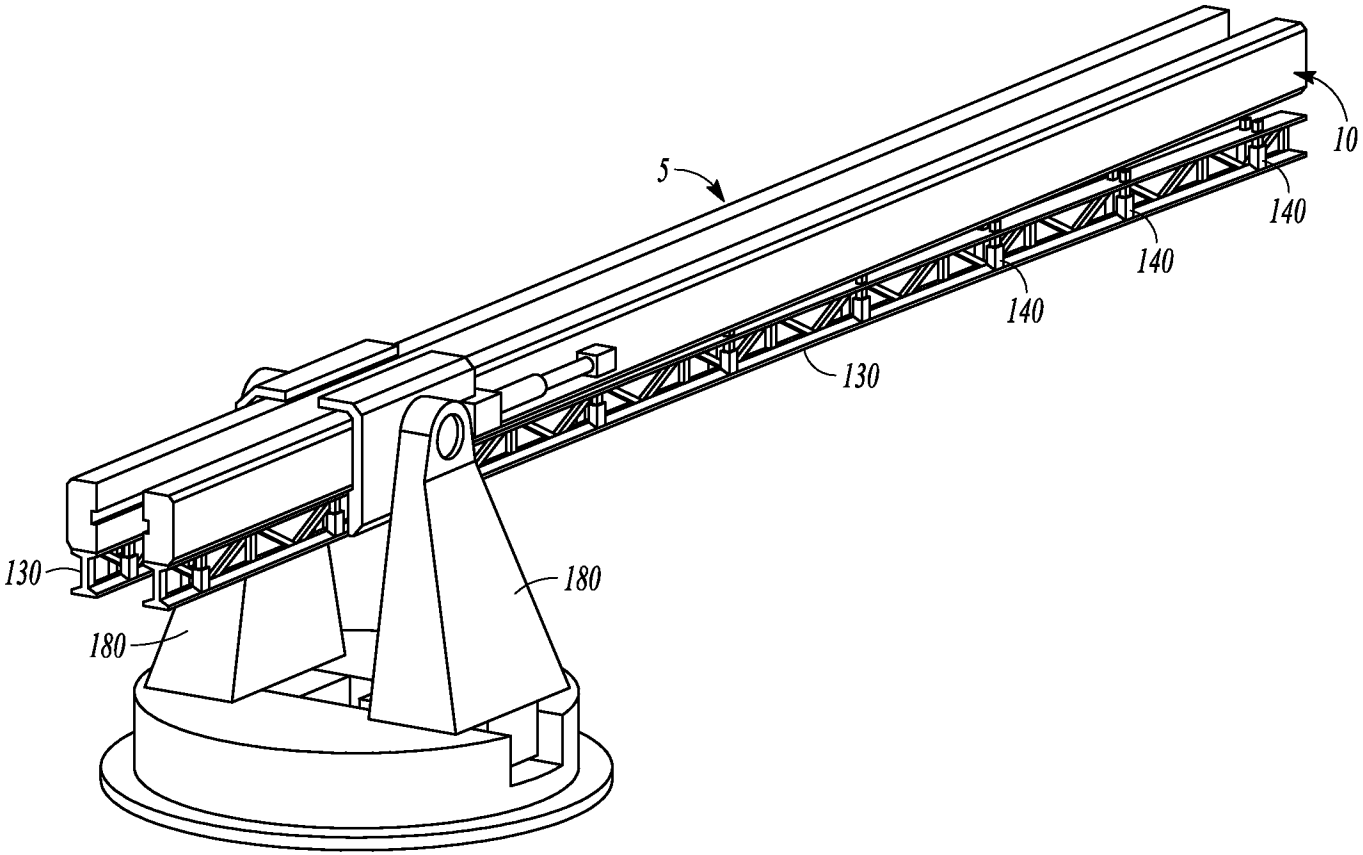
FIG. 11 shows a split-mount support for horizontally expandable launcher, according to an example.

In a horizontally expandable embodiment of the launcher, a short section of which is depicted in FIG. 10, the open motors 5 and 10 are positioned so that they mirror each other on opposite sides of a vertical plane. In this configuration the support structure and the mechanism for spacing the open motors apart can be modified, for example as shown in FIG. 11. The trusses 130 supporting open motors in this configuration can be pulled apart by a split gun mount 180, with its halves capable of being adjustably spaced apart by a servo mechanism (installed, for example, between them). Actuators 140 in this configuration can be used exclusively for droop compensation.

The repositioning mechanisms providing adjustable spacing, droop compensation and recoil mitigation for expandable electromagnetic launchers in the disclosed above embodiments based on open simple railgun can be used, "as is" or with slight modifications, with other types of open motors, including the open ultra-segmented high-current motor disclosed in the next section.

Laterally Open Ultra-Segmented High-Current Linear Motor.

Figure 12:
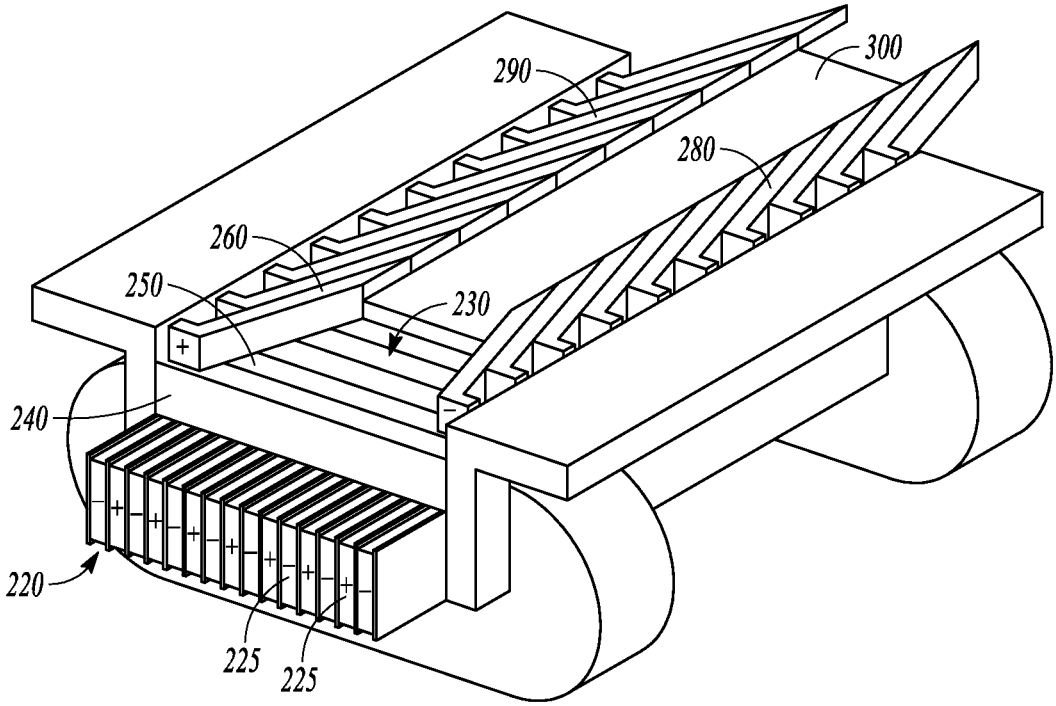
FIG. 12 shows a section of open ultra-segmented high-current linear motor, according to an example.

FIG. 12 depicts a short section of the laterally open ultra-segmented motor 8, according to an embodiment. Its core comprises the laminated buswork 220 serving as a transmission line distributing electrical current to the segments of the coextending ultra-segmented stator 230.

The laminated buswork 220 can include a plurality of stacked long parallel metal plates 225 electrically insulated from each other on the interfaces between them, and also electrically insulated from the elements of the containment structure. The even numbered plates can be connected to one terminal of a pulse power source, and the odd numbered to the terminal of opposite polarity; thus the conductors carrying the currents of two opposite directions in the buswork are interleaved. By increasing the number of plates while maintaining their total cross section area and total current, the magnetic pressure, mainly existing only between the plates, can be lowered. It can suffice to use as many plates as needed to make magnetic pressure in the buswork several times lower than the maximum level of magnetic pressure in the stator. The total number of plates used in the buswork can be odd, so that the first and the last plates are of like polarity. The present subject matter is not limited to the illustrated configuration, and can include other configurations in which a plurality of conductors, carrying the currents in opposite directions, are interleaved to form a low-inductance transmission line, with inductance per unit-length $10^{-7}$ H/m (henry per meter) or less. Other examples include, but are not limited to, an assembly of multiple parallel coaxial conductors forming a high-current transmission line, distributing current to the segments of an ultra-segmented stator.

The ultra-segmented stator 230 can be built as an assembly of thin stator segments. The stator comprises segments of two kinds, 240 and 250, stacked together in alternating order. The segments 240 and 250 mechanically support two kinds of elongated metal members 260 and 270 positioned, respectively, at the left and the right sides of each segment and inclined with respect to the launch direction at an acute angle. The preferred inclination angle can depend on a variety of design factors, and, by controlling certain geometrical parameters, can gradually vary along the launch path, provided that the launch channel remains essentially straight. The elongated metal members 260 and 270 can be viewed as arms of contact brushes. Their tips are cut parallel to the launch direction to slidably contact the armature as it travels by. The insert 300 preferably made of a stiff insulating material serves as a side wall of the open propulsion channel between built-up rails 280 and 290, and is pre-compressed to minimize deflection of built-up rails caused by their repulsion.

Figure 13:
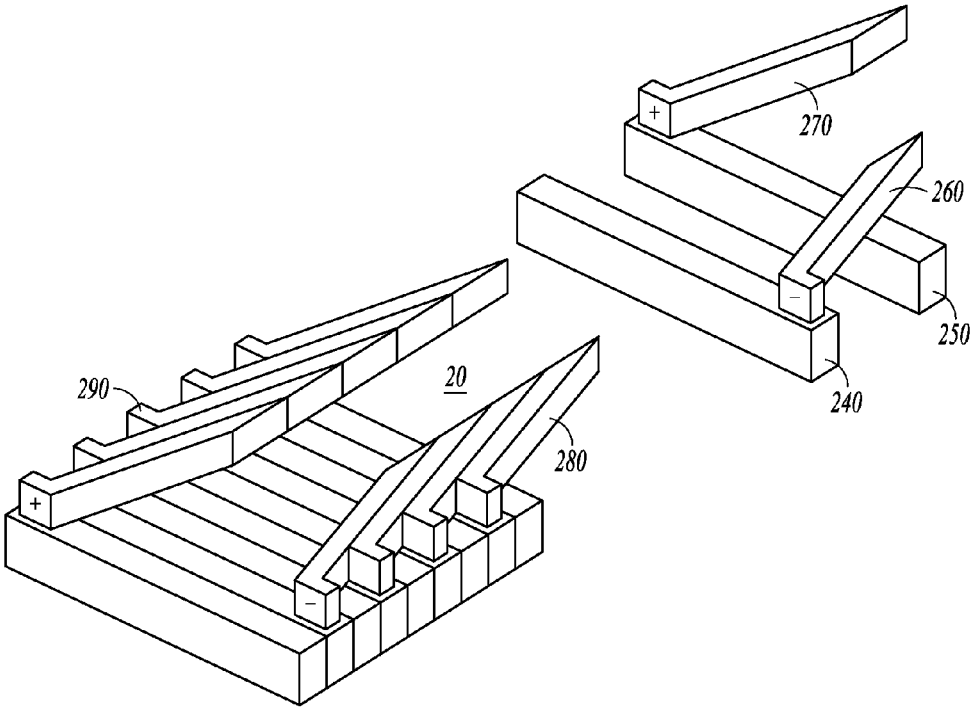
FIG. 13 shows a stacked stator of open ultra-segmented high-current linear motor, according to an example.

In addition to providing mechanical support for the metal brushes 260 and 270, the stator segments can electrically connect the brushes to the current-carrying conductors, such as plates, that can comprise, but are not limited to, a laminated buswork. In the figure, odd numbered segments are connected to the plates of one polarity, while even numbered segments are connected to the plates of the opposite polarity. The stator segments 240 and 250 thus have opposite polarities and are electrically insulated from each other at the interfaces between them. In FIGS. 12 and 13 they are shown with electrically insulating housing.

For clarity, FIG. 13 shows a portion of the ultra-segmented stator including an exploded view of stator segments 240 and 250. The shape of stator segments can be such that they are alignable into a stack, e.g., when they are most tightly arranged in alternating order, with few or no gaps remaining between inclined brush arms of like polarity, as well as between their flat portions. Thus in a stator assembly the brushes can form two rather rigid built-up contact rails 280 and 290, with an open propulsion channel 20 between them.

In each built-up rail, the brushes are of like polarity. Nevertheless they can be insulated from each other by a thin layer of electrical insulation, except possibly near their contact tips. This ensures that the electric current in the brushes flows to the contact tips along the inclined brush arms without jumping from one brush arm to the neighboring one. In other words, this ensures that built-up rails conduct the electric current anisotropically, obliquely with respect to the launch direction, and, in contrast with rails of simple railgun, that they are unable to conduct electric current from breech end of the built-up rail to the muzzle end.

The described embodiment of ultra-segmented electromagnetic launcher with obliquely conducting, mechanically rigid built-up contact rails composed of inclined metal brushes can be called an electromagnetic brushgun to distinguish it from other launchers in the railgun family. Note, that railgun armatures comprising metal contact brushes have been a feature of multiple patents and technical publications going back for dozens of years, but obliquely conducting built-up rails assembled of tightly stacked together inclined metal brushes contacting the armature at their tips were introduced only much later, in Dreizin reference, wherein an ultra-segmented architecture was presented by a design example with laterally closed propulsion channel.

Figure 14:
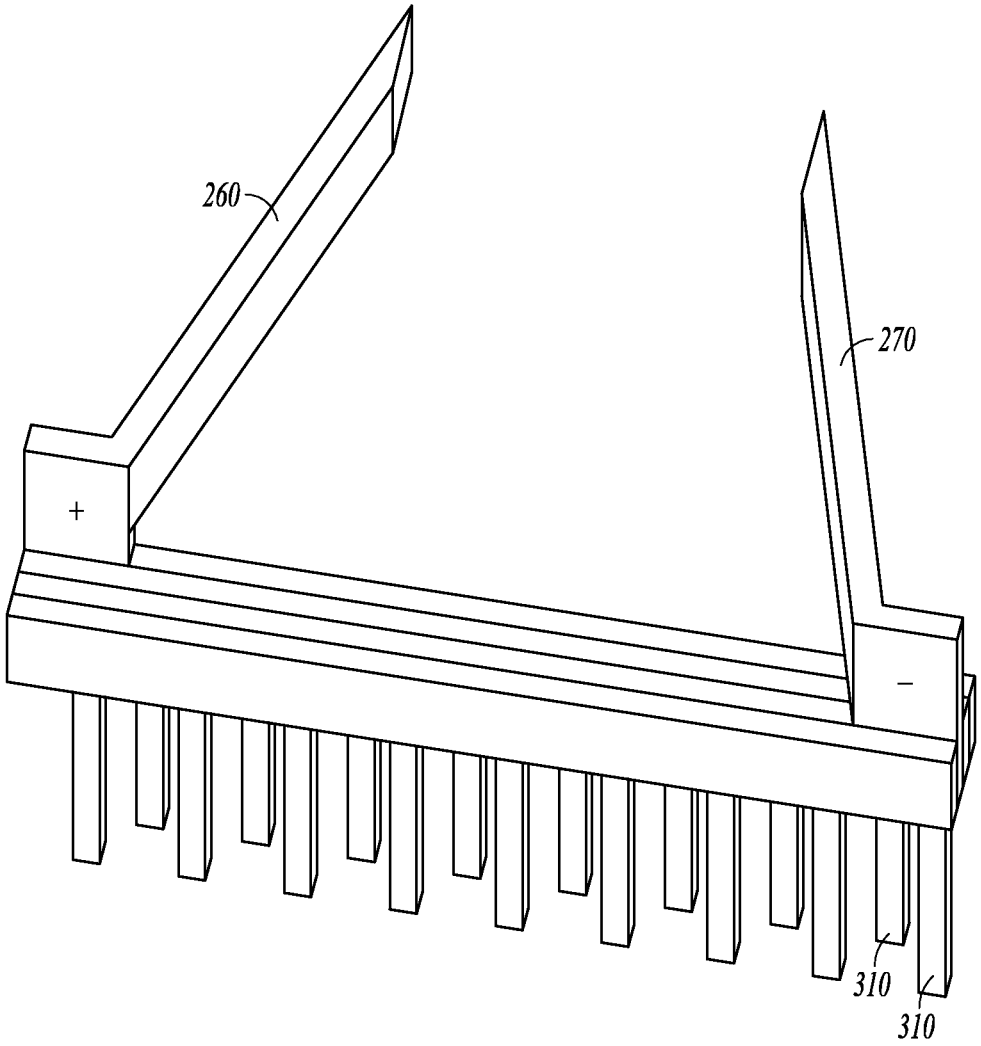
FIG. 14 shows stator segments with prongs, according to an example.

In one form shown in FIG. 14 the electrical connection between the stator segments and the plates of like polarity in the laminated buswork can be made using prongs 310. The prongs can be plugged into outlets formed in the plates of the laminated buswork, and possibly brazed and/or welded to the plates.

Figure 15:
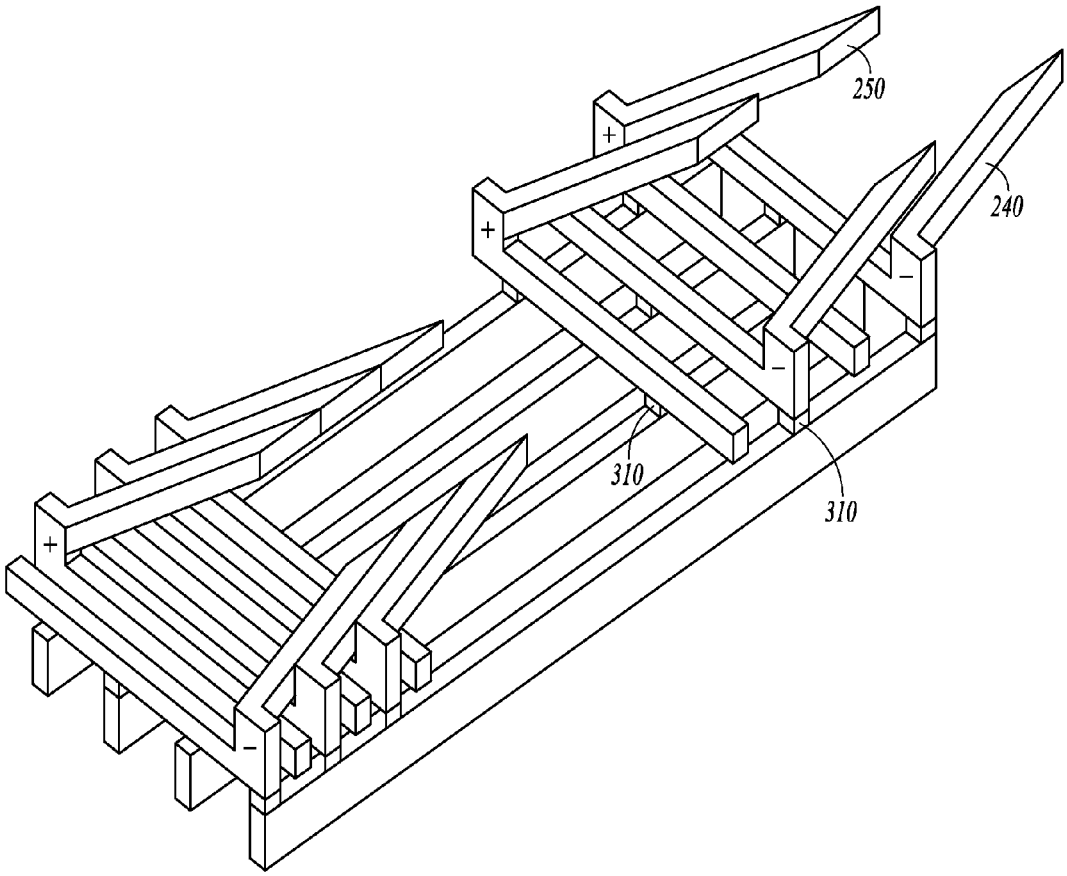
FIG. 15 shows a connection of stator segments of open ultra-segmented motor with buswork plates, according to an example.

For additional clarity, the exemplar embodiments of segments of ultra-segmented stator in depicted in FIG. 14 and their connections to the buswork plates are shown in FIG. 15 schematically and naked to the metal, without the insulating housing or spacers. The electrically conducting metal core of one such segment can be cut out, completely with the brush and the prongs, from a single piece of sheet metal, such as copper or aluminum, and bent to form the inclined brush. In some ultra-segmented motors, the spaced metal buswork plates and the set of the stator segments with tightly stacked brush arms can be assembled "naked" as shown, and then the voids between the metal element of the structure can be filled with epoxy resin or some other settable insulator.

Figure 16:
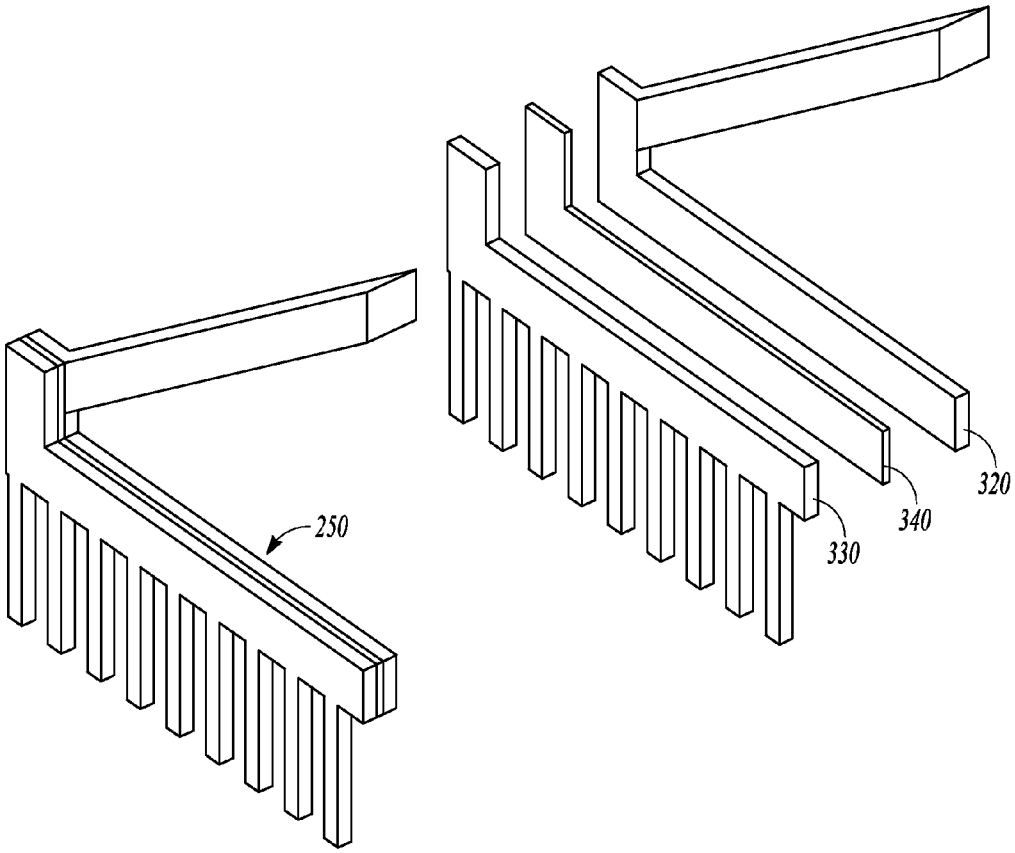
FIG. 16 shows a stator segment of ultra-segmented motor with posistor layer, according to an example.

In another embodiment shown in FIG. 16, the electrically conducting core of stator segments can include two metal parts, a brush bracket 320 and the connector plate 330 separated by an insert 340 made serving as a pulsed posistor, that is, an element having initially rather low resistance (e.g., with respect to electrical current passing through on its way from the connector plate to the brush bracket) but quickly increasing significantly towards the end of the current pulse. Such posistor behavior can help mitigate concentration of electric current at the rear end of the armature at the armature/rail contact, which is analogous to the well-known phenomenon of velocity skin effect in railguns with electrically continuous rails.

The laterally open ultra-segmented motors as described above, or in equivalent embodiments, can be contained by the containment structure and coupled with power actuated repositioning mechanisms analogous to those shown in FIG. 7 and FIG. 11 for the expandable launchers based on open simple railguns.

Various Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An electromagnetic launcher for accelerating a launch package when energized by a high-current pulse power source, the electromagnetic launcher comprising:

A. a plurality of laterally open high-current linear electrical motors coextending along a length of the launcher, each motor having a laterally open propulsion channel configured to receive a portion of a metal armature of the launch package and configured to permit the launch package to slide along the channel such that in each motor an electric current flows, via sliding contacts, in and out of a respective portion of the metal armature inserted in the channel, and B. a manually actuated or power actuated repositioning mechanism coupled with the plurality of laterally open high-current linear motors and configured to adjust a spacing between the propulsion channels of the plurality of laterally open high-current linear motors.

2. The electromagnetic launcher of claim 1, wherein at least one of the plurality of high-current linear electrical motors is a laterally open railgun comprising two electrically and mechanically continuous coextending generally parallel rails connected to a power source.

3. The electromagnetic launcher of claim 1, wherein at least one of the motors is a laterally open ultra-segmented high-current linear motor comprising:

A. an electrical transmission line including conductors carrying opposing currents aligned and interleaved to reduce the electrical transmission line inductance per unit length below $10^{-7}$ H/m, the line extending generally parallel to the launch direction; and B. an ultra-segmented stator coextending with the transmission line, the stator having a plurality of built-up rails parallel to the launch direction, the rails comprising stacked together elongated metal members inclined with respect to the launch direction, with tips of the metal members cut parallel to the launch direction, wherein said metal members belonging to each built-up rail are electrically connected to the conductors of the transmission line of like polarity while insulated from one another on interfaces between them, and wherein the laterally open propulsion channel is between the built-up rails.

4. The electromagnetic launcher of claim 1, wherein at least one high-current linear electric motor comprises at least one one-sided clamp providing preloading to a core of the at least one high-current linear electric motor.

5. The electromagnetic launcher of claim 2, wherein at least one laterally open railgun comprises at least one one-sided clamp providing preloading to a core of the open railgun.

6. The electromagnetic launcher of claim 3, wherein at least one laterally open ultra-segmented high-current linear motor comprises at least one one-sided clamp providing preloading to an ultra-segmented motor core.

7. The electromagnetic launcher of claim 1, wherein the power actuated repositioning mechanism comprises a plurality of servo actuators and controllers configured to compensate for droop, in addition to repositioning motors with respect to each other.

8. The electromagnetic launcher of claim 2, wherein the power actuated repositioning mechanism comprises a plurality of servo actuators and controllers configured to compensate for droop, in addition to repositioning motors with respect to each other.

9. The electromagnetic launcher of claim 3, wherein the power actuated repositioning mechanism comprises a plurality of servo actuators and controllers configured to compensate for droop, in addition to repositioning motors with respect to each other.

10. The electromagnetic launcher of claim 1, comprising removable inserts disposed between motors on opposite sides of a propulsion channel to space apart the motors.

11. The electromagnetic launcher of claim 2, comprising removable inserts disposed between motors on opposite sides of a propulsion channel to space apart the motors.

12. The electromagnetic launcher of claim 3, comprising removable inserts disposed between motors on opposite sides of a propulsion channel to space apart the motors.

13. The electromagnetic launcher of claim 1, comprising a first support structure coupled with at least one motor to support the at least one motor.

14. The electromagnetic launcher of claim 2, comprising a first support structure coupled with at least one motor to support the at least one motor.

15. The electromagnetic launcher of claim 3, comprising a first support structure coupled with at least one motor to support the at least one motor.

16. The electromagnetic launcher of claim 13, comprising a rotatable mount coupled to the first support structure to aim the launcher, wherein the rotatable mount is coupled to a second support structure and configured to separate the first support structure from the second support structure.

17. The electromagnetic launcher of claim 14, comprising a rotatable mount coupled to the first support structure to aim the launcher, wherein the rotatable mount is coupled to second support structure and configured to separate the second support structure from the first support structure.

18. The electromagnetic launcher of claim 15, comprising a rotatable mount coupled to the first support structure to aim the launcher, wherein the rotatable mount is coupled to second support structure and configured to separate the first support structure from the second support structure.

19. The electromagnetic launcher of claim 1, wherein the laterally open propulsion channels are configured to receive respective sides of respective metal armatures of launch packages of different transverse sizes; and wherein the repositioning mechanism is configured to adjust the spacing between the propulsion channels of the plurality of high-current linear electrical motors into a plurality of respective configurations to accommodate the launch packages of different transverse sizes to respectively propel them when energized by the pulse power source.

* * * * *